US008946602B2

(12) United States Patent
Hertzberg et al.

(10) Patent No.: US 8,946,602 B2
(45) Date of Patent: Feb. 3, 2015

(54) CONVECTION SYSTEM AND BAFFLE FOR OVEN

(75) Inventors: Brian T. Hertzberg, Madison, WI (US); Benjamin W. Hanson, Stoughton, WI (US); David T. Oudenhoven, Madison, WI (US)

(73) Assignee: Wolf Appliance, Inc., Fitchburg, WI (US)

( * ) Notice: Subject to any disclaimer, the term of this patent is extended or adjusted under 35 U.S.C. 154(b) by 159 days.

(21) Appl. No.: 13/390,553

(22) PCT Filed: Aug. 17, 2010

(86) PCT No.: PCT/US2010/045786

§ 371 (c)(1),
(2), (4) Date: Apr. 27, 2012

(87) PCT Pub. No.: WO2011/022419

PCT Pub. Date: Feb. 24, 2011

(65) Prior Publication Data

US 2012/0211482 A1 Aug. 23, 2012

Related U.S. Application Data

(60) Provisional application No. 61/235,275, filed on Aug. 19, 2009.

(51) Int. Cl.
*A21B 1/00* (2006.01)
*F24C 15/32* (2006.01)

(52) U.S. Cl.
CPC ..... *F24C 15/322* (2013.01)
USPC ..... 219/400; 219/409; 126/21 A

(58) Field of Classification Search
USPC ..... 219/400, 409, 412, 507; 126/21 A; 165/104.34, 181
See application file for complete search history.

(56) References Cited

U.S. PATENT DOCUMENTS

| | | | | |
|---|---|---|---|---|
| 4,029,463 | A | 6/1977 | Johansson et al. | |
| 4,909,236 | A | 3/1990 | Del Fabbro | |
| 5,568,803 | A | 10/1996 | Brown | |
| 2003/0172919 | A1 | 9/2003 | Rabas et al. | |
| 2004/0163635 | A1 | 8/2004 | Thorneywork | |
| 2010/0006085 | A1 * | 1/2010 | Thomas et al. | 126/21 A |

FOREIGN PATENT DOCUMENTS

| | | |
|---|---|---|
| DE | 3742234 | 6/1989 |
| EP | 0794390 | 9/1997 |
| JP | 5340542 | * 12/1993 |

OTHER PUBLICATIONS

European Search Report and Search Opinion issued in EP Application No. 10810503.2, Oct. 30, 2012.
International Search Report and Written Opinion received in PCT/US2010/045786, Feb. 11, 2011.

* cited by examiner

*Primary Examiner* — Shawntina Fuqua
(74) *Attorney, Agent, or Firm* — Bell & Manning, LLC

(57) ABSTRACT

An oven includes an oven chamber having a cavity at least partially defined by a door, a pair of side walls, and a rear wall; a baffle extending lengthwise between the pair of side walls, the baffle having an arcuate shape along at least a portion of its length; a heating element located between the baffle and the rear wall; and a first tangential fan configured to direct air over the heating element and through the baffle. The distance between the baffle and the rear wall is greater near the sidewalls than at the midpoint between the side walls.

20 Claims, 10 Drawing Sheets

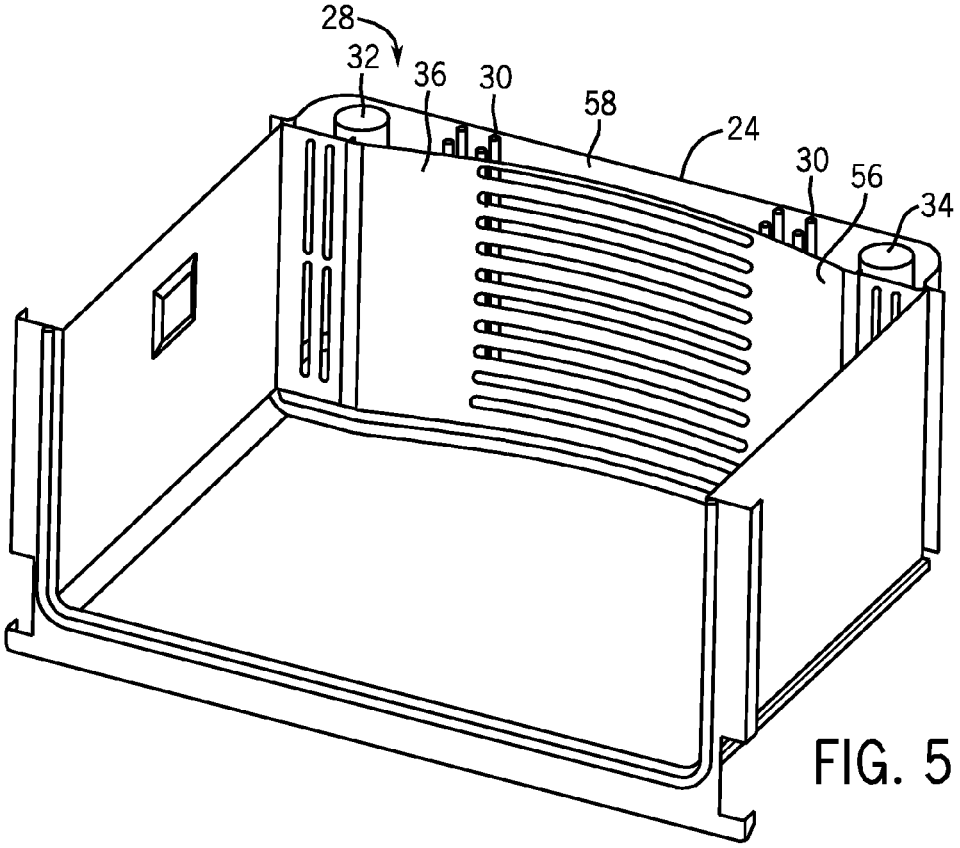
FIG. 5
FIG. 6
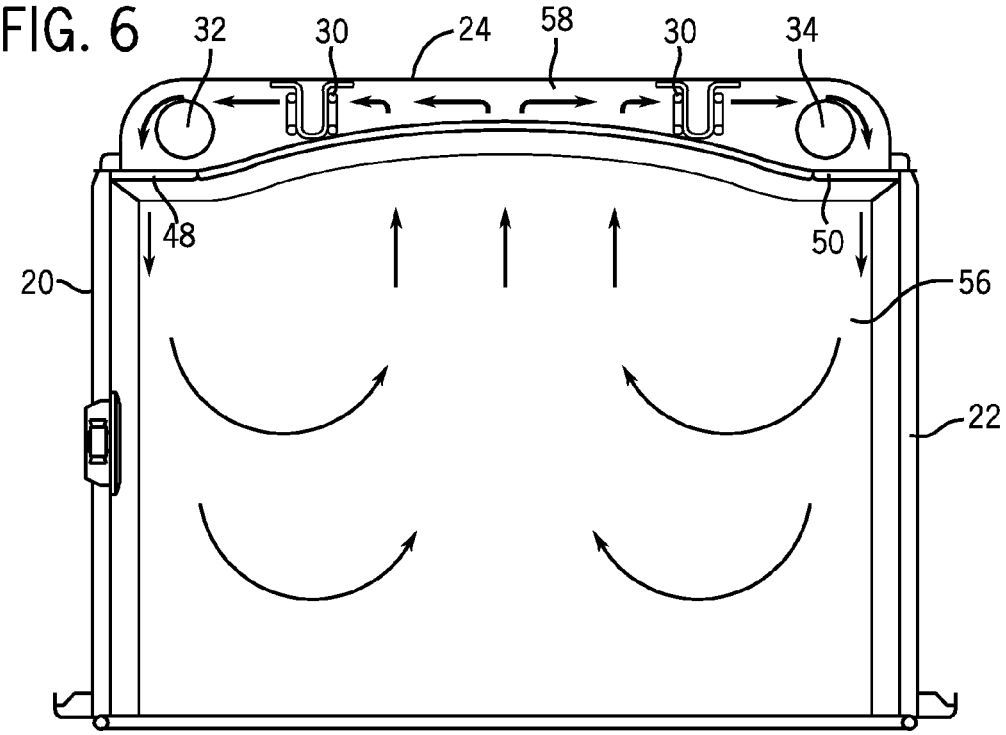

CONVECTION SYSTEM AND BAFFLE FOR OVEN

CROSS-REFERENCE TO RELATED APPLICATIONS

This application is a National Phase Entry of International Application No. PCT/US2010/045786, filed Aug. 17, 2010, which claims priority to U.S. Provisional Application No. 61/235,275, filed Aug. 19, 2009, which is incorporated herein by reference in its entirety.

BACKGROUND

The present application relates to a heating system for an oven. More specifically, the present application relates to a convection heating system for an oven.

Ovens mounted in a wall or as part of a range are generally known. Referring to FIGS. 1 and 2, many such ovens include an oven cavity and a convection system. The convection system typically includes one or more axial fans and a baffle. The fan or fans create an air flow through openings in the back wall of the oven cavity. The baffle obscures the fan and directs the air flow to desired areas of the oven cavity.

SUMMARY

According to one embodiment, an oven comprises an oven chamber having a cavity at least partially defined by a door, a pair of side walls, and a rear wall; a baffle extending lengthwise between the pair of side walls, the baffle having an arcuate shape along at least a portion of its length; a heating element located between the baffle and the rear wall; and a first tangential fan configured to direct air over the heating element and through the baffle; wherein the distance between the baffle and the rear wall is greater near the sidewalls than at the midpoint between the side walls.

According to another embodiment, an oven comprises a chamber having a cavity, the cavity defined at least partially by a rear wall, opposing sidewalls, a top wall, and a bottom wall; a baffle extending between the sidewalls and dividing the cavity into a front cavity and a rear cavity, the front cavity configured to receive foods for cooking, the baffle comprising a curved portion and a pair of planar portions provided on opposite sides of the curved portion; and a pair of tangential fans, each fan extending vertically between the top and bottom walls along one of the sidewalls and within the rear cavity; wherein the tangential fans are configured to pull air from the front cavity into the rear cavity through the curved portion of the baffle, and direct the air from the rear cavity back into the front cavity through the planar portions of the baffle.

According to another embodiment, an oven comprises an oven chamber having a cavity at least partially formed by a first side wall, a second side wall, a rear wall, and a door opposite the rear wall; a non-linear baffle extending between the first and second side walls; and a convection heat system comprising a first tangential fan and a second tangential fan, the first tangential fan located adjacent the interface of the rear wall and the first side wall, the second tangential fan located adjacent the interface of the rear wall and the second side wall, both the first and second tangential fans having a vertical axis of rotation to produce an air flow toward the door along the respective sidewall.

The present disclosure further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

BRIEF DESCRIPTION OF THE DRAWINGS

FIG. 5 is a cutaway perspective view of the oven of FIG. 3 according to an exemplary embodiment.

FIG. 6 is a top cross section view of the oven of FIG. 3 according to an exemplary embodiment.

DETAILED DESCRIPTION

Figures 1, 2:
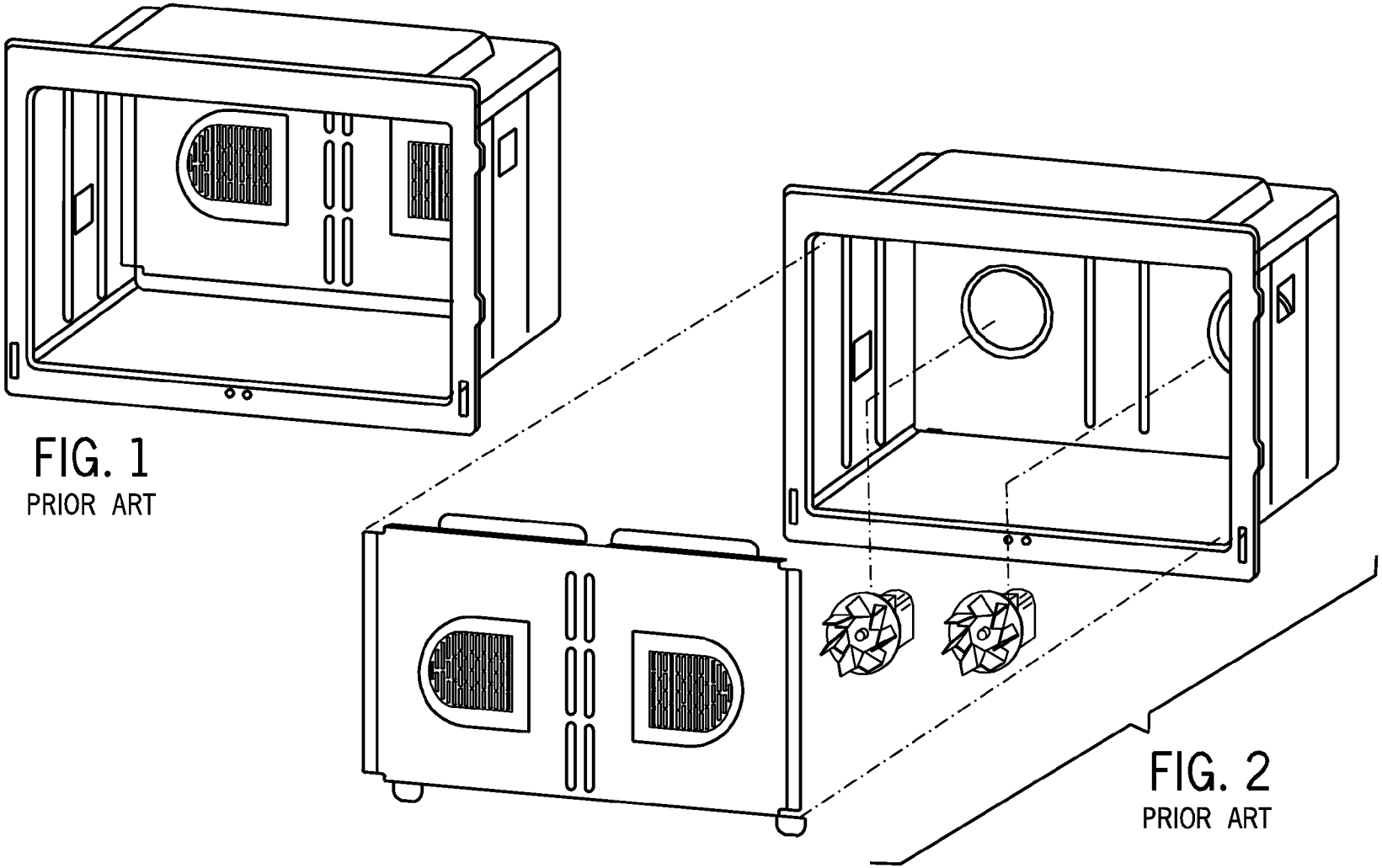
FIG. 2 PRIOR ART
FIG. 1 PRIOR ART
FIG. 1 is a perspective view of a known oven design.
FIG. 2 is an exploded view showing a cavity, fan, and baffle of the known oven design of FIG. 1.
Figure 3:
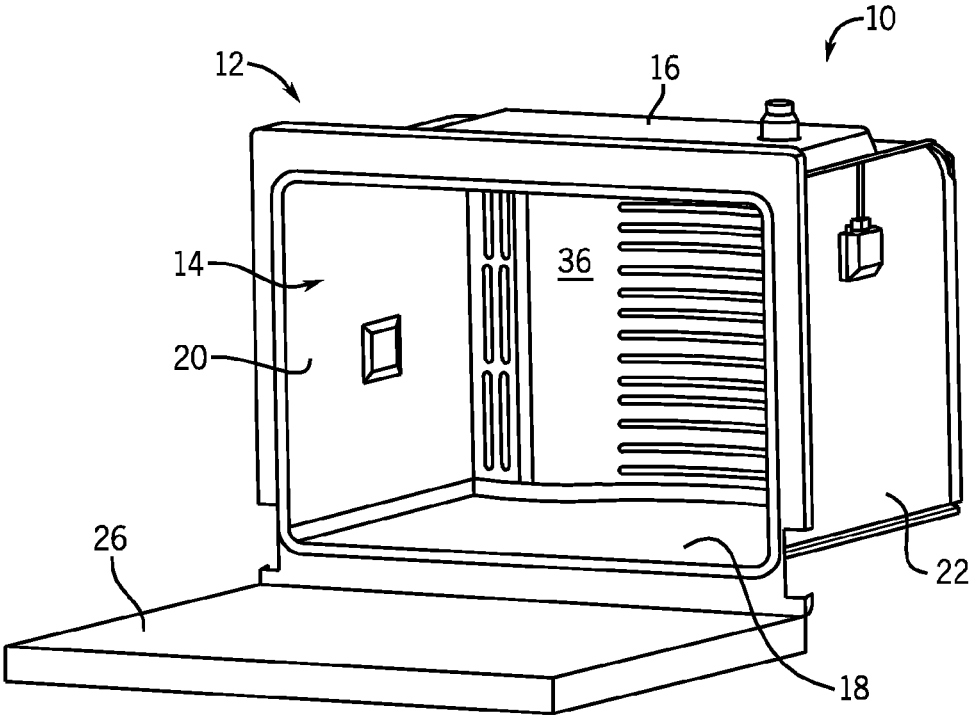
FIG. 3 is a perspective view of an oven according to an exemplary embodiment.

Referring to FIGS. 3-6, an oven 10 (e.g., a forced air convection oven) is shown according to an exemplary embodiment. Oven 10 comprises an oven housing or chamber 12 that defines a cavity 14. Oven 10 further includes a convection heat system 28 (see FIG. 5). Other components of oven 10 may include a user interface (e.g., that provides a temperature selector input and a mode selector input), one or more temperature sensors (e.g., that sense the temperature of the oven cavity) and a controller or control system (e.g., that monitors and regulates oven cavity air temperature). Oven 10 may be operated in any of a plurality of modes, depending on the type of cooking desired.

According to an exemplary embodiment, chamber 12 includes a top wall 16, a bottom wall 18, side walls 20, 22, a rear wall 24 (see FIG. 5), and a door 26. Door 26 is provided at the front of oven 10 to permit food to be placed in and removed from oven cavity 14. In some embodiments, the various wall members may be joined using mechanical fasteners, welding, etc. In other embodiments, one or more wall member may be formed from a single piece of material. Food to be baked or cooked may be placed on a plurality of vertically adjustable, horizontal racks (not shown) within oven cavity 14.

In some embodiments, convection heat system 28 is intended to improve cavity airflow within oven 10 relative to traditional radial fan systems (see FIGS. 1-2). Referring to FIGS. 5-6, according to an exemplary embodiment, convection heat system 28 includes a heat source or heating element 30, one or more tangential blowers or fans 32, 34 (e.g., cross-flow blowers, cross-flow fans, etc.), and a baffle 36 (e.g. a divider, wall member, inlet/out, etc.).

Figure 4:
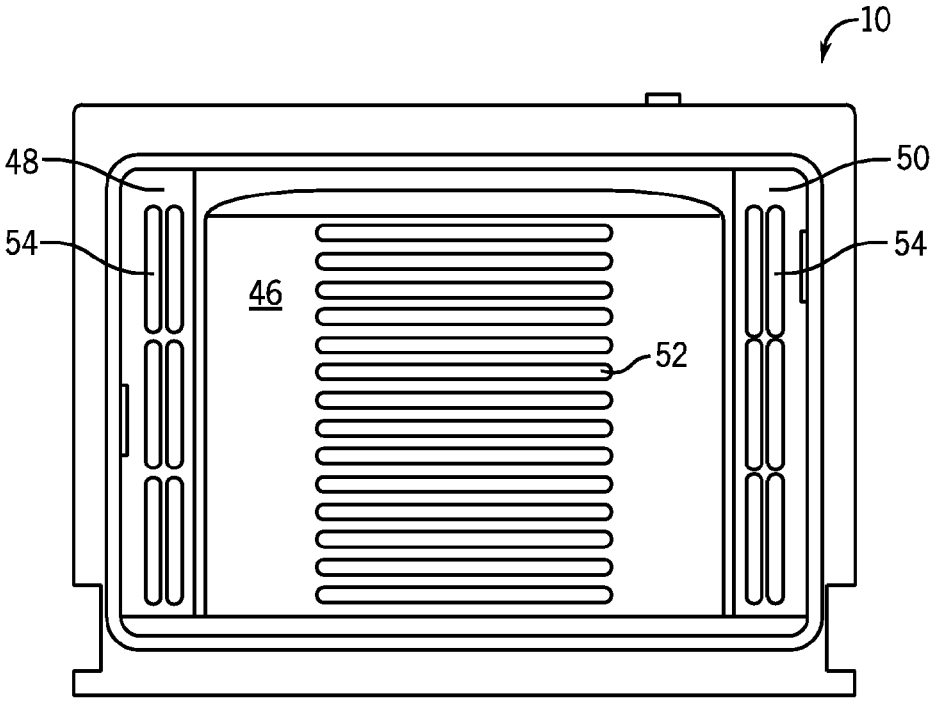
FIG. 4 is a front view of the oven of FIG. 3 according to an exemplary embodiment.
Figure 7:
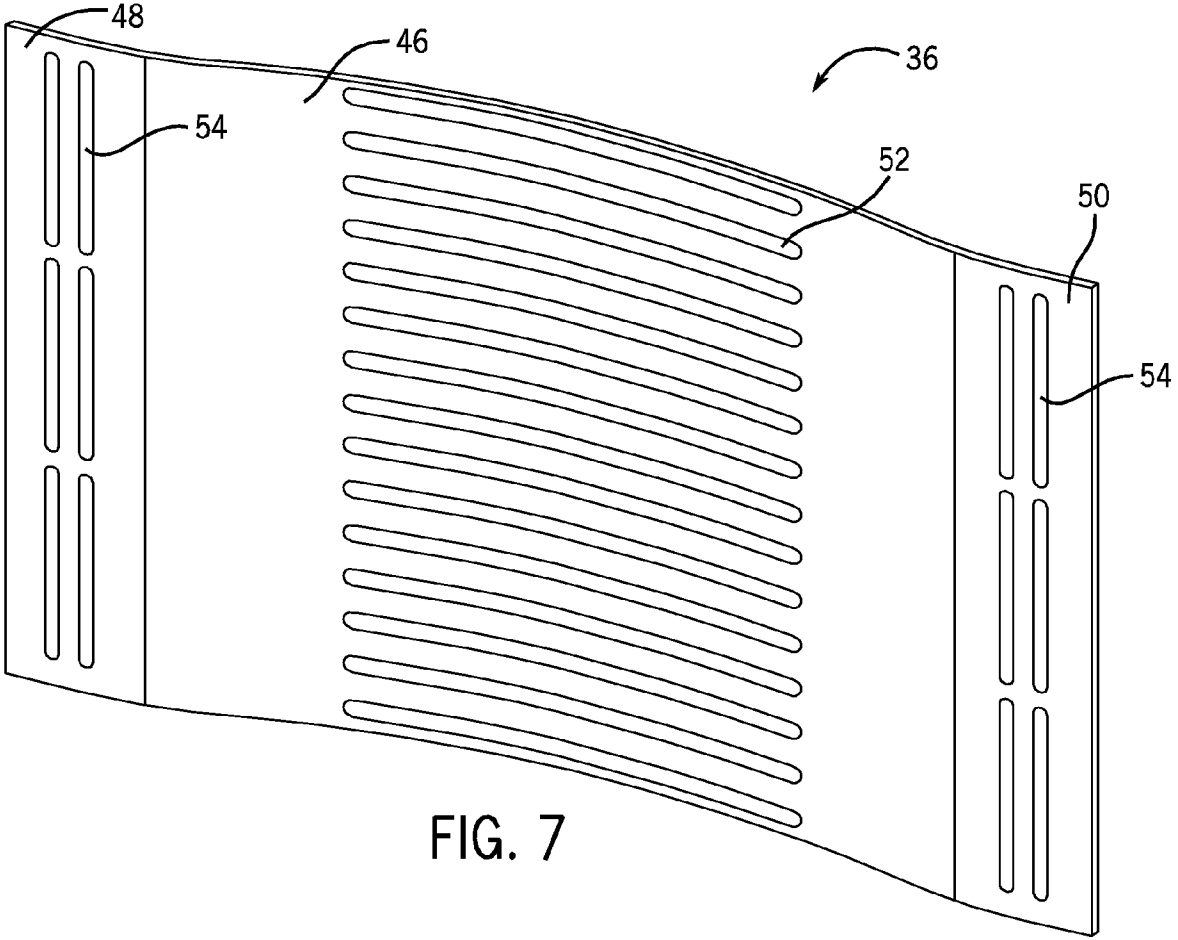
FIG. 7 is a perspective view of a baffle of the oven of FIG. 3 according to an exemplary embodiment.
Figure 9:
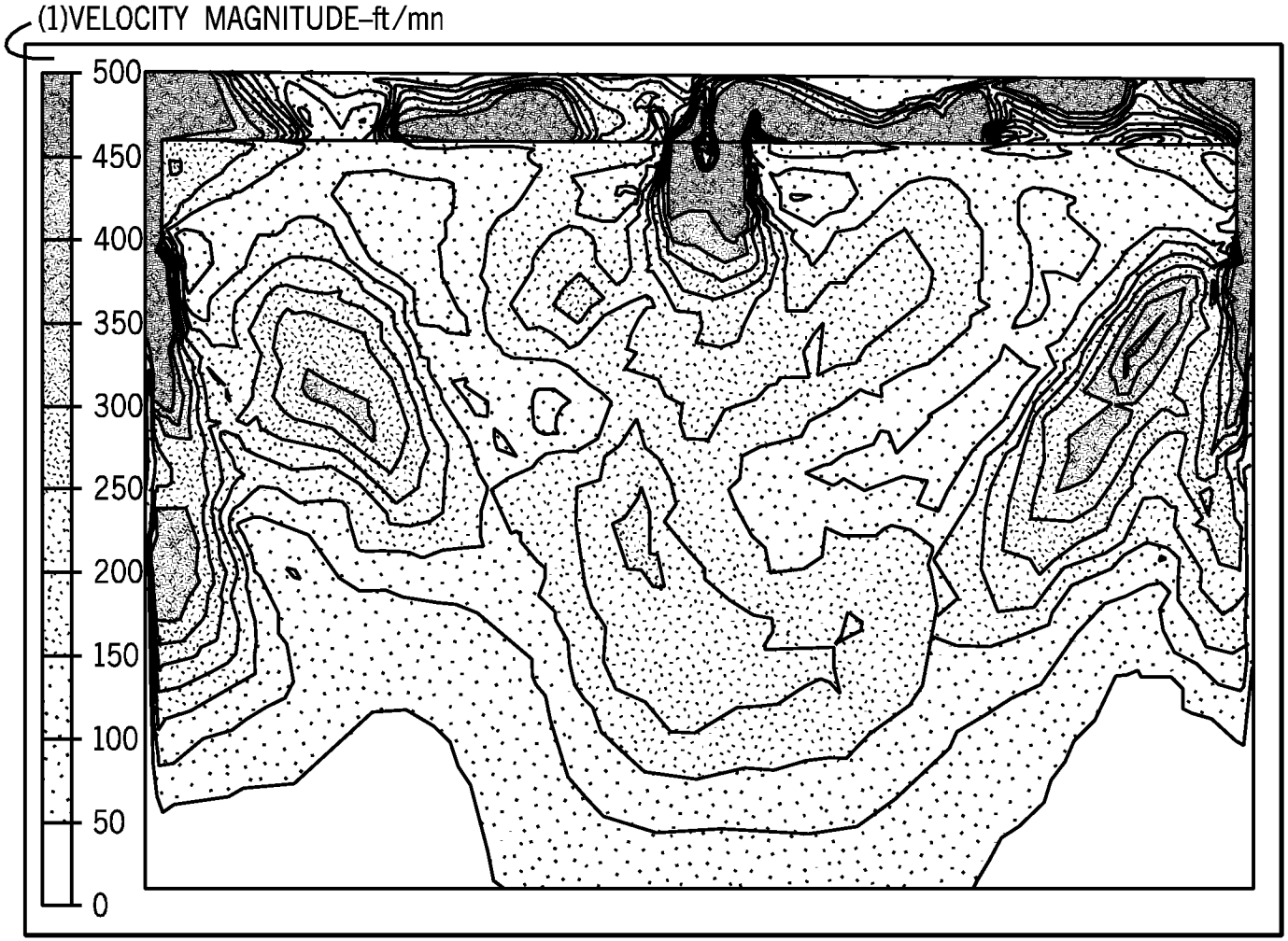
FIGS. 9-11 are a series of section views showing air velocity gradients at different horizontal planes within the oven of FIGS. 1 and 2.
Figure 10:
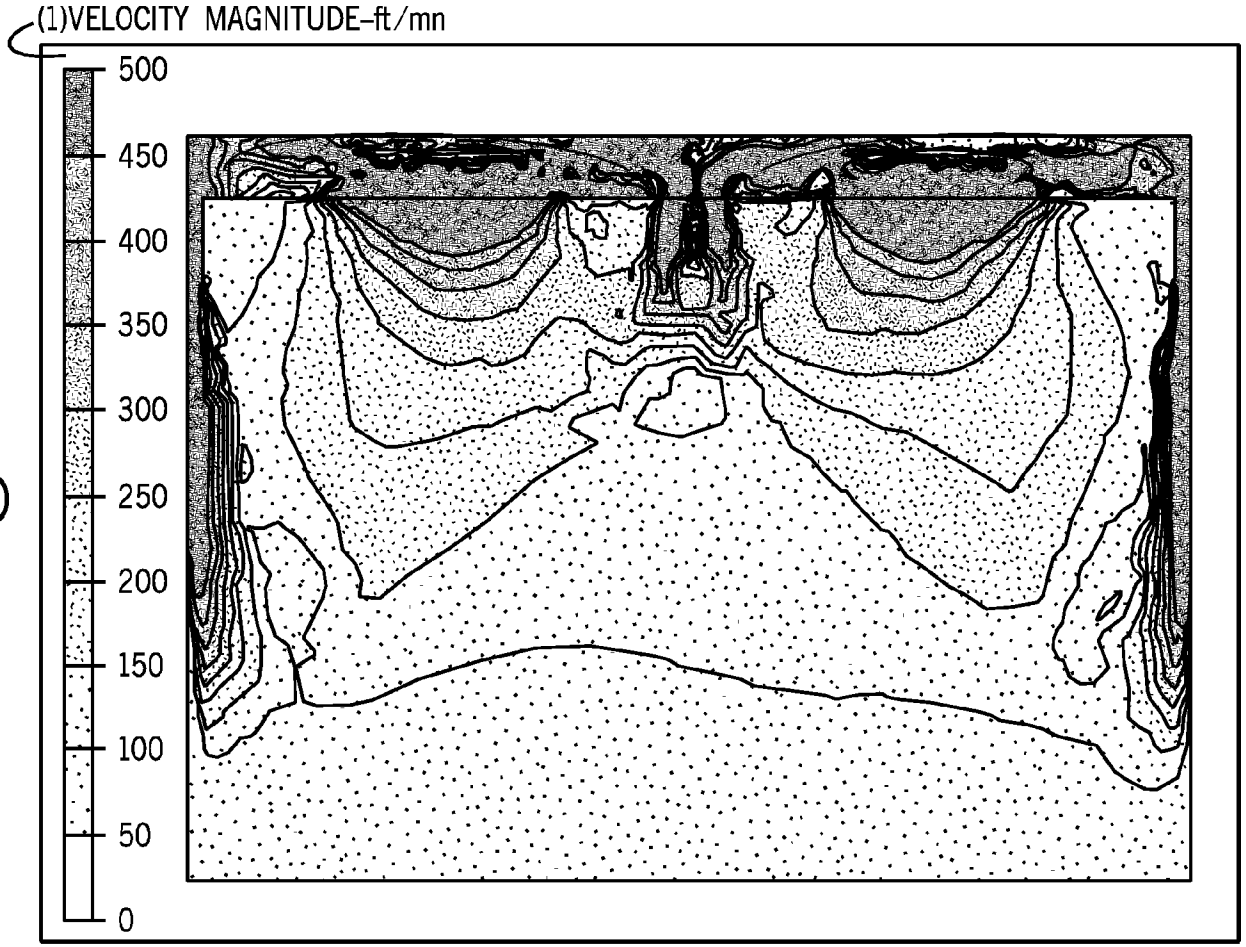
Figure 11:
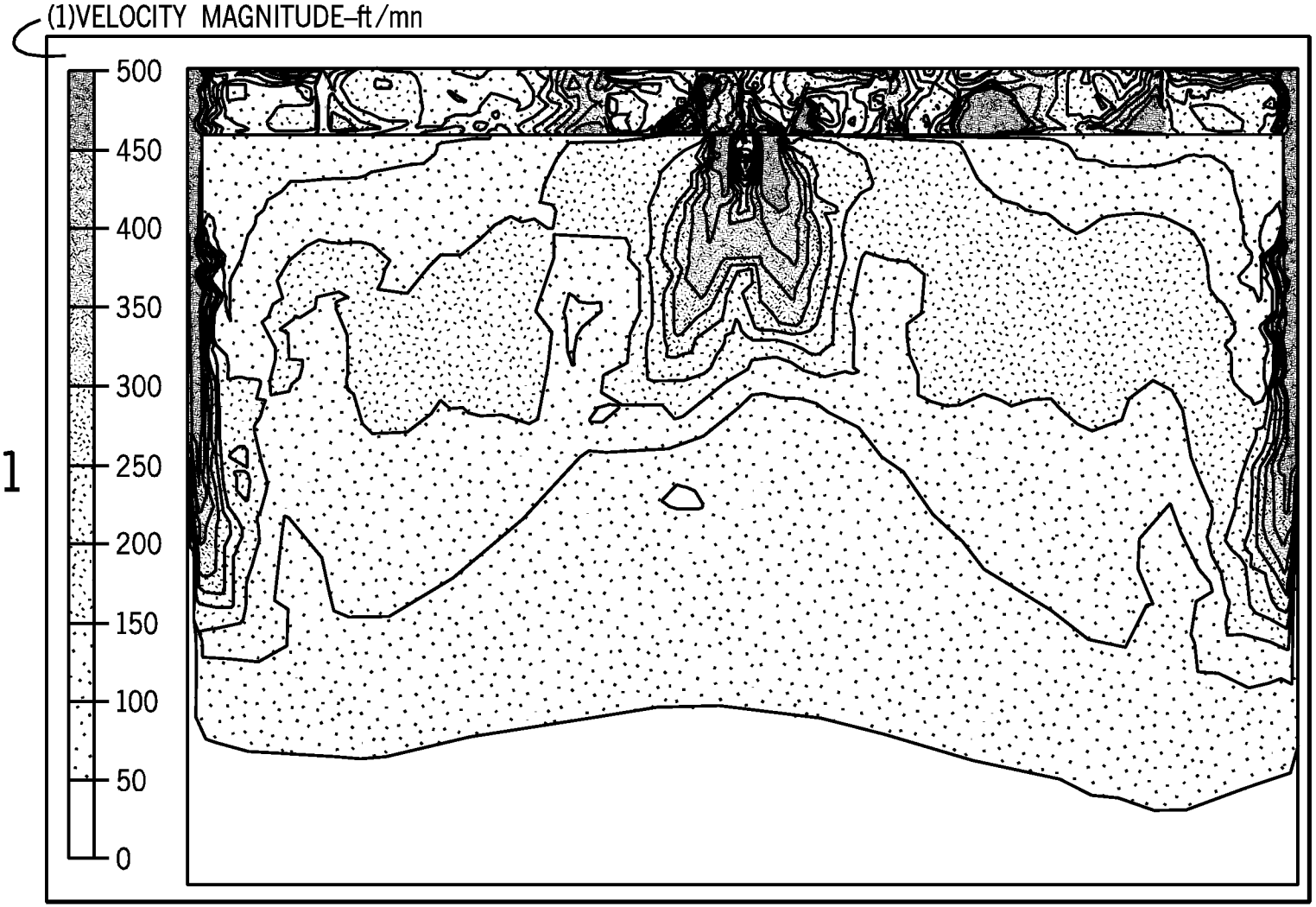

Referring to FIGS. 4-6, according to one embodiment, baffle 36 extends (e.g., laterally, lengthwise, etc.) between side walls 20, 22 and may be curved along at least a portion of its length between side walls 20, 22. Baffle 36 divides cavity 14 into a front, or first cavity 56 (e.g., a cooking space, a cavity suitable to receive food for cooking, etc.) and a rear, or second cavity 58 (e.g., the space between baffle 36 and rear wall 24). Baffle 36 is located at the rear of oven cavity 14 and together with side walls 20, 22, top wall 16, and bottom wall 18, defines front cavity 56. Baffle 36 includes separate inlet and outlet portions (e.g., apertures, etc. as discussed in greater detail below) for fans 32, 34. As shown in FIGS. 4-6, baffle 36 may have an arcuate (e.g., curved, nonlinear, arched, etc.) portion extending along all or a portion of its length between side walls 20, 22. For example, as also shown in FIG. 7, according to an exemplary embodiment, baffle 36 includes a curved portion 46 (e.g., a middle portion, a nonlinear or arcuate portion, an inlet, etc.) and a pair of generally planar side portions 48, 50 (flat or planar portions, side members, outlets, etc.) on opposite sides of curved portion 46. The distance between baffle 36 and rear wall 24 is greater near side walls 20, 22 than at a midpoint of baffle 36 between sidewalls 20, 22. In some embodiments, side portions 48, 50 of baffle 36 may be generally perpendicular to side walls 20, 22. In one embodiment, baffle 36 may be formed from a single piece of material. According to other embodiments, curved portion 46 and side portions 48, 50 may be formed separately and joined together using any suitable joining method (e.g., welding, mechanical fasteners, etc.).

Referring to FIGS. 4-5 and 7, baffle 36 may include a number of apertures to facilitate the passage of air between front cavity 56 and rear cavity 58. For example, as shown in FIG. 4, curved portion 46 may include a plurality of horizontal apertures 52 (e.g., slits, slots, ovals, elongated apertures, rectangular apertures, etc.) that are generally parallel and may be substantially evenly spaced along the height of baffle 36 between top wall 16 and bottom wall 18. Side portions 48, 50 may include vertical apertures 54, which may be a group of parallel slits, slots, or similar apertures. As discussed in greater detail below, apertures 52, 54 facilitate airflow between front cavity 56 and rear cavity 58 of oven 58. According to various alternative embodiments, the shape, size, orientation, spacing, etc. of apertures 52, 54 may be varied from the illustrated embodiments herein to suit a particular application.

According to various exemplary embodiments, heating element 30 may include or be any of a variety of heat sources, such as a burner or an electric resistive element (e.g., a "Calrod" heating rod or element, etc.). For example, in one embodiment, heating element 30 comprises a plurality of heating rods. According to one embodiment, the heating rods may be positioned such that a first portion of the heating rods are positioned to a first side of curved portion 46 and a second portion of the heating rods are positioned to a second side of curved portion 46. In further embodiments, the heating rods may be placed to the outside of apertures 52 such that the heating rods are not visible from front cavity 56 (e.g., such that the heating rods are not visible to users of oven 10, providing a cleaner and more aesthetically pleasing appearance to the interior of oven 10). In some embodiments, heating element 30 may be turned on/off by a control system when desired or at certain times during the cooking operation. Furthermore, oven 10 may include additional and/or separate heating elements on the inlet or exhaust side of the system.

Figure 8:
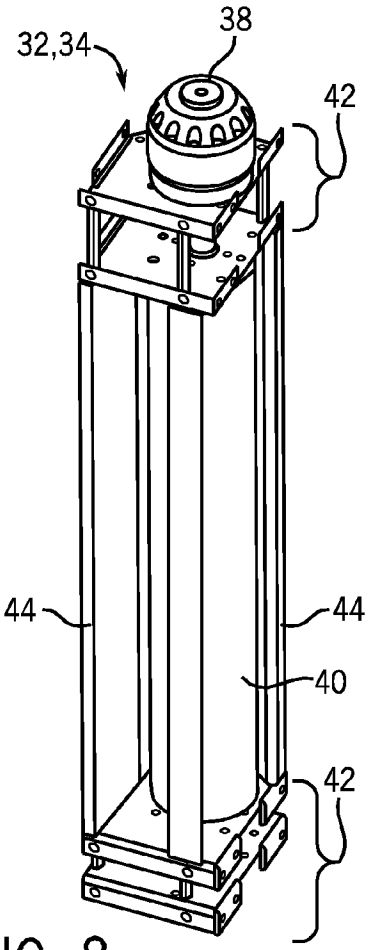
FIG. 8 is a perspective view of a fan of the oven of FIG. 3 according to an exemplary embodiment.

According to an exemplary embodiment, fans 32, 34 are configured to improve air flow through oven cavity 14 (e.g., between and/or within front cavity 56 and rear cavity 58). Improved air flow is intended to provide consistent heat distribution throughout front cavity 56, including across horizontal planes or levels within front cavity 56 (e.g., where food would be located on racks), and between the various horizontal planes within front cavity 56. As shown in FIG. 8, each fan 30, 32 includes a motor 38, an impeller 40 (e.g., scroll wheel), and a bearing system 42. In some embodiments, impeller 40 is located within oven cavity 14, with motor 38 residing on the outside of cavity 14. In further embodiments, fans 32, 34 may further include a housing portion 44. Housing portion 44 may form a portion of rear wall 24 and/or side walls 20, 22. Bearing systems 42 capture both ends of impeller 40 and are configured to reduce or minimize friction of impeller 40. The bearing location may reside within or outside of cavity 14.

According to one embodiment, fans 32, 34 may be located within rear cavity 58. For example, fans 32, 34 may be provided in one or both of the rear corners of rear cavity 58 (e.g., behind baffle 36 and adjacent rear wall 24 and side walls 20, 22). According to one embodiment, fans 32, 34 are orientated vertically such that the rotational axis of the impeller is vertical. The vertical orientation of the tangential fan is intended to provide a linear exhaust pattern over all cooking levels from top to bottom of cavity 56. For example, impeller 40 may extend along all or a substantial portion of the height of cavity 56, such that fans 32, 34 provide for even air distribution along the height of cavity 56.

As shown in FIGS. 5-6, in one embodiment, the intake side of fans 32, 34 is adjacent rear wall 24 and the pressure, or outlet side, is adjacent side walls 20, 22. As such, air for the system will intake along a partial portion, or the entire portion, of rear wall 24, and air will exhaust forward along side walls 20, 22, then circulate inward through baffle 36 and be redrawn into rear cavity 58. In this way, fans 32, 34 draw air from front cavity 56, through baffle 36 (e.g., through apertures 52 in curved portion 46) and over heating element 30. After the air passes through fans 32, 34, it is outlet, or exhausted, from rear cavity 58, back through baffle 36 (e.g., back through apertures 54 in side portions 48, 50), and back into front cavity 56. As air is outlet through side portions 48, at least a portion of the air tends to travel along side walls 20, 22 toward door 26. As discussed below, this airflow pattern may increase oven efficiency relative to other air flow configurations.

Baffle 36 and oven cavity 14 providing increased efficiency over more traditional configurations. Unusable air space inside the oven cavity (e.g., rear cavity 58), which cannot be used to cook food and reduces the oven efficiency calculation, is reduced or minimized. As shown in FIG. 6, curving baffle 36 increases the usable oven space (i.e., cooking space), relative to ovens having a planar rear surface or baffle (e.g., where a rear surface may extend in a straight fashion between side portions 48, 50), while decreasing dead oven space (e.g., the space occupied by rear cavity 58).

Baffle 36 is also configured to provide improved cosmetic appeal, by reducing or eliminating fan blade visibility, and providing slits or slots rather than the traditional screen as shown in FIGS. 1-2. The curvature or arch of baffle 36 is configured to provide a simple and clean line to the oven interior (see, e.g., FIG. 4). According to alternative embodiments, baffle 36 may be any of a variety of shapes (e.g., contours, curvatures, etc.), and have any of a variety of openings for air flow (e.g., holes, angled slots, etc.).

Figure 12:
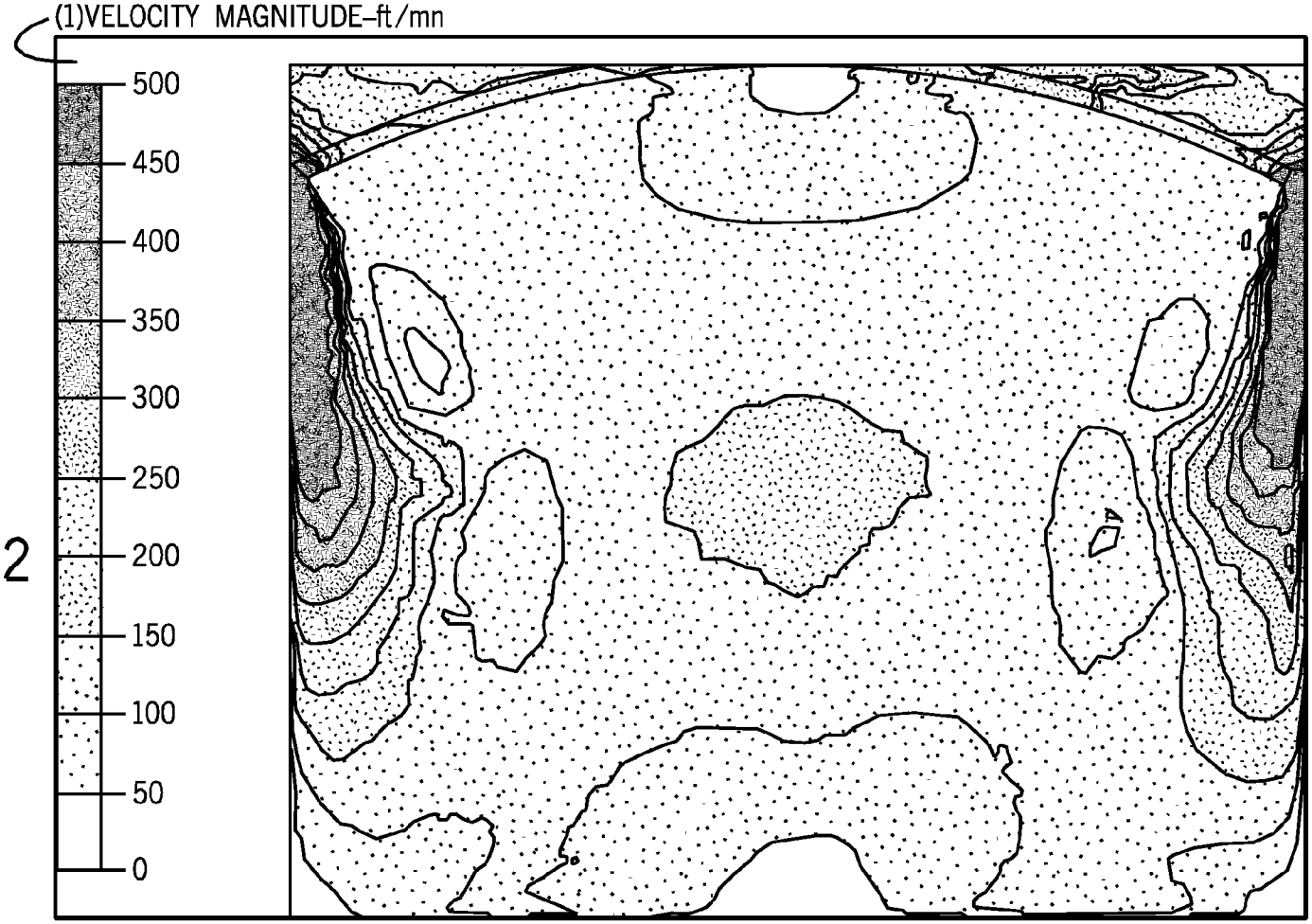
FIGS. 12-14 are a series of section views showing air velocity gradients at different horizontal planes within the oven of FIG. 3 according to an exemplary embodiment.
Figure 13:
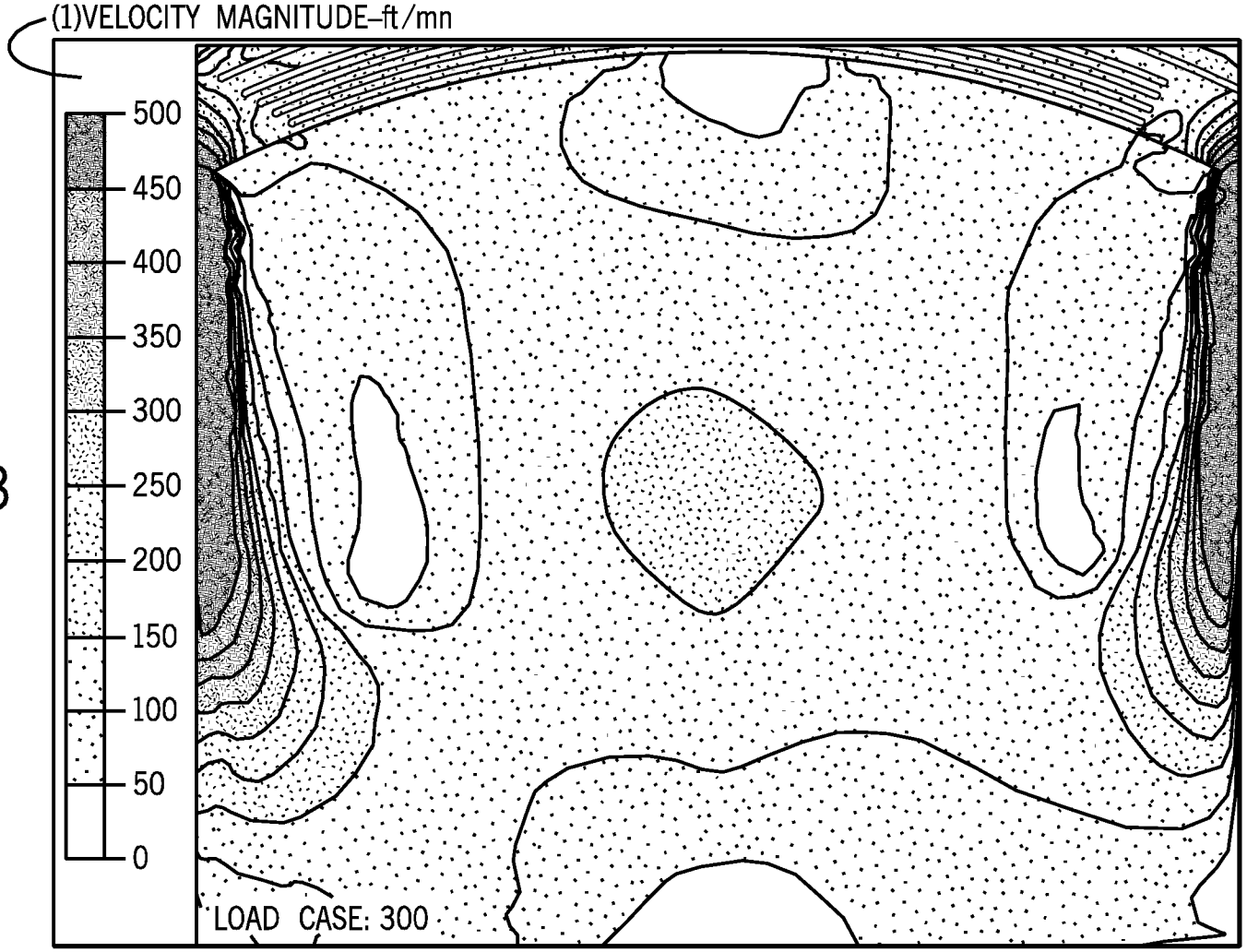
Figure 14:
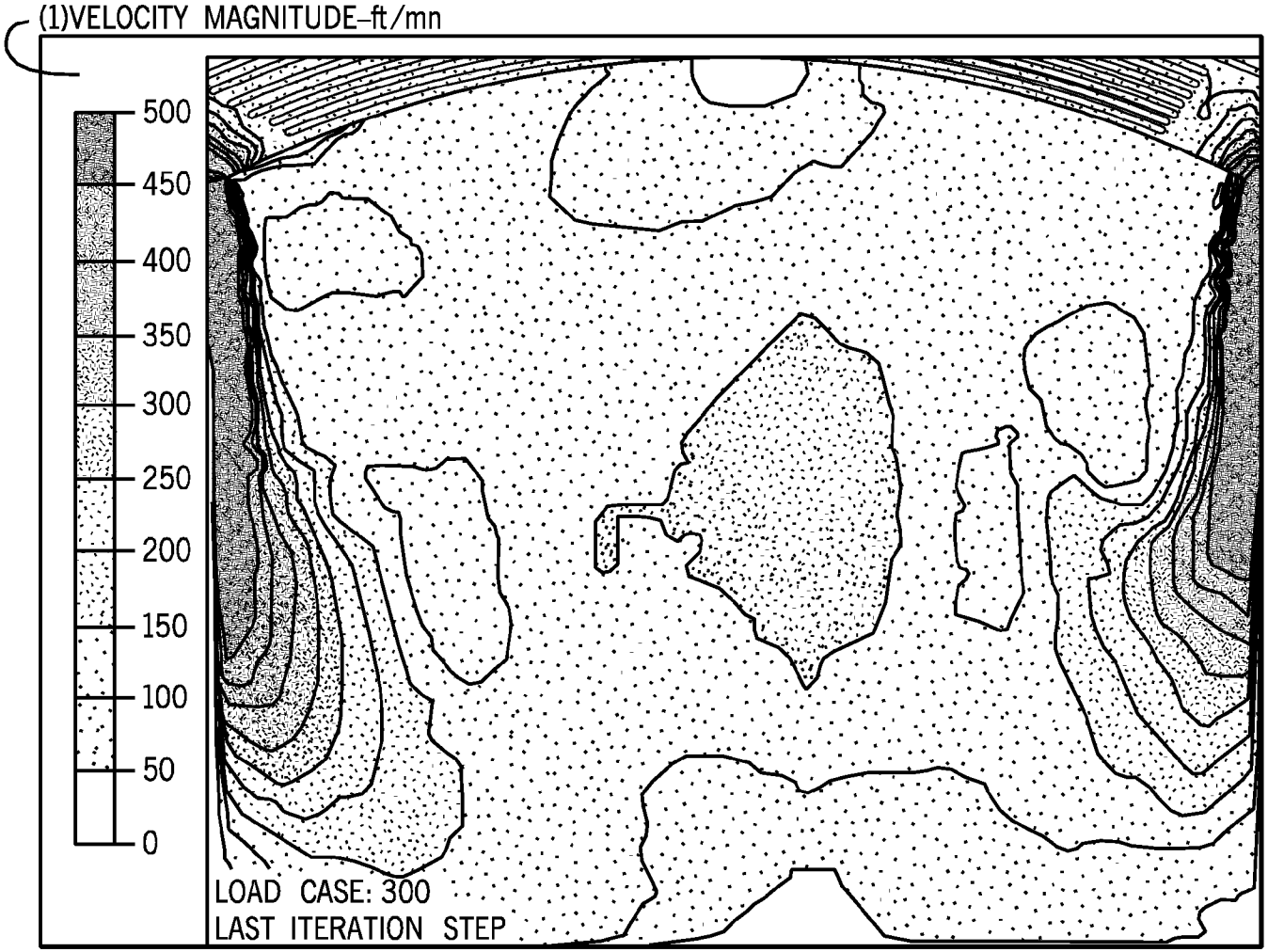

Referring now to FIGS. 9-11 and 12-14, air velocity gradients at various vertical levels within an oven are shown for a traditional convection system (FIGS. 9-11) compared to an exemplary embodiment of the present disclosure (FIGS. 12-14). Generally, in a convection system, heat transfer is a function of temperature and air velocity. The more uniform the air velocity, the more uniform the heating of the food within the oven. In FIGS. 9-14, the preferred cooking environment would be provided by having (i) the same color (tone, shading, etc.) in the central portion of each horizontal plane (e.g., each horizontal plane representing, for example, a different rack height within the oven) and (ii) the same color pattern across the various horizontal planes. The exemplary embodiment (shown in FIGS. 12-14) shows that the air velocity is consistent (more uniform) across the horizontal planes and between the vertically spaced horizontal planes. As such, the exemplary embodiment may provide a more uniform air velocity, and therefore a more uniform heat transfer than a traditional oven.

In some embodiments, an oven comprises an oven chamber having a cavity at least partially defined by a door, a pair of side walls, and a rear wall; an arcuate baffle extending substantially between the pair of side walls; a heating element assembly located between the baffle and the rear wall and comprising a heating element and a first tangential fan. The distance between the arcuate baffle and the rear wall is greater near the sidewalls than at the midpoint between the side walls.

In some embodiments, an oven may alternatively comprise an oven chamber, a non-linear baffle, and a convection heat system. The oven chamber includes a cavity at least partially formed by a first side wall, a second side wall, a rear wall, and a door opposite the rear wall. The baffle extends at least substantially between the side walls. The convection heat system comprises a first tangential fan and a second tangential fan. The first tangential fan is located adjacent the interface of the rear wall and the first side wall. The second tangential fan is located adjacent the interface of the rear wall and the second side wall. Both the first and second tangential fans have a vertical axis of rotation to produce an air flow toward the door along the respective sidewall.

While the components of the disclosed embodiments may be illustrated for use in a convection oven built in a wall, designed for other oven arrangements, the features of the disclosed embodiments have a much wider applicability. For example, the convection heating system is adaptable for other oven applications such as stand-alone ranges, grills and other home, consumer, commercial, or industrial ovens which employ a storage space configured to rotate relative to a base. Further, the size of the various components and the size of the oven and/or components can be widely varied.

It is also important to note that the construction and arrangement of the elements of the oven as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the oven may be a wall mounted single or dual oven, incorporated in a range, a stand alone appliance, or the like. Accordingly, all such modifications are intended to be included within the scope of the present disclosure as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the exemplary embodiments without departing from the spirit of the present disclosure as expressed in the appended claims.

What is claimed is:

1. An oven comprising:

an oven chamber having a cavity at least partially defined by a door, a top wall, a bottom wall, a pair of side walls, and a rear wall;

a baffle mounted in the cavity between the pair of side walls, the baffle having an arcuate shape along a majority of its length between the pair of side walls;

a heating element located between the baffle and the rear wall; and a first tangential fan comprising a first impeller mounted between the top wall and the bottom wall such that a first rotational axis of the first impeller is vertical, the first tangential fan configured to direct air over the heating element and through the baffle;

wherein the distance between the baffle and the rear wall is greater near the side walls than at the midpoint between the side walls.

2. The oven of claim 1 further comprising a second tangential fan comprising a second impeller mounted between the top wall and the bottom wall such that a second rotational axis of the second impeller is vertical, wherein the first and second tangential fans are positioned between the baffle and the rear wall and adjacent a side wall of the pair of side walls.

3. The oven of claim 1, wherein the baffle comprises an arcuate middle portion and two generally planar portions provided on opposite sides of the arcuate middle portion.

4. The oven of claim 2, wherein the baffle substantially divides the cavity into a first cavity for cooking food and a second cavity; and wherein the first and second fans are configured to pull air from the first cavity through a middle portion of the baffle and into the second cavity, and back into the first cavity through planar portions of the baffle provided on opposite sides of the middle portion.

5. The oven of claim 1, wherein a middle portion of the baffle comprises a plurality of generally parallel and horizontally extending apertures configured to permit air to pass through the baffle.

6. The oven of claim 5, wherein the baffle further comprises a plurality of generally parallel and vertically extending apertures on opposite sides of the middle portion that are configured to permit air to pass through the baffle.

7. The oven of claim 1, wherein the baffle comprises a plurality of generally parallel, elongated apertures; and wherein the heating element comprises a plurality of vertically extending heating rods mounted so that the heating rods are not visible through the generally parallel, elongated apertures from the front of the oven.

8. The oven of claim 1, wherein the fan further comprises a motor and a bearing system coupling the motor to the impeller; and wherein the motor is positioned to the exterior of the cavity.

9. An oven comprising:

a chamber having a cavity, the cavity defined at least partially by a rear wall, opposing sidewalls, a top wall, and a bottom wall, wherein the opposing sidewalls extend between the top wall and the bottom wall;

a baffle mounted to and extending between the sidewalls and dividing the cavity into a front cavity and a rear cavity, the front cavity configured to receive foods for cooking, the baffle comprising a curved portion and a pair of planar portions provided on opposite sides of the curved portion; and a pair of tangential fans, each fan comprising an impeller that extends vertically between the top and bottom walls adjacent one of the sidewalls and within the rear cavity;

wherein the tangential fans are configured to pull air from the front cavity into the rear cavity through the curved portion of the baffle, and direct the air from the rear cavity back into the front cavity through the planar portions of the baffle.

10. The oven of claim 9, wherein the tangential fans are configured to direct air back into the front cavity toward the door and along each of the sidewalls.

11. The oven of claim 9, further comprising a heating element provided in the rear cavity, wherein the tangential fans are configured to pull air across the heating element.

12. The oven of claim 11, wherein the heating element comprises a plurality of heating rods, a first portion of the heating rods being positioned to a first side of the curved portion, and a second portion of the heating rods being positioned to a second side of the curved portion.

13. The oven of claim 9, wherein the curved portion of the baffle forms a concave surface relative to the front cavity and in a direction extending between the sidewalls.

14. The oven of claim 9, wherein the curved portion comprises a plurality of parallel horizontally elongated apertures spaced substantially evenly along a height of the baffle between the top and bottom walls.

15. The oven of claim 14, wherein each of the planar portions comprises a plurality of parallel vertically elongated apertures configured to permit air to pass between the front and rear cavities.

16. An oven comprising:

an oven chamber having a cavity at least partially formed by a first side wall, a second side wall, a rear wall, and a door opposite the rear wall;

a baffle extending between the first and second side walls and curved along a majority of its length in a horizontal direction between the first and second side walls; and a convection heat system comprising a first tangential fan and a second tangential fan, the first tangential fan located adjacent the interface of the rear wall and the first side wall, the second tangential fan located adjacent the interface of the rear wall and the second side wall, both the first and second tangential fans comprising an impeller that forms a vertical axis of rotation to produce an air flow toward the door along the respective sidewall.

17. The oven of claim 16, wherein the baffle is curved such that the distance between the baffle and the rear wall is greater near the sidewalls than at the midpoint between the side walls.

18. The oven of claim 17, wherein the baffle comprises a curved middle portion having a plurality of horizontally elongated apertures, and a plurality of generally planar side portions, at least one planar side portion having a plurality of vertically elongated apertures.

19. The oven of claim 16, further comprising a heating element provided between the baffle and the rear wall and between the first and second tangential fans.

20. The oven of claim 19, wherein a middle portion of the baffle is curved and the heating element comprises a plurality of heating rods, wherein a first portion of the heating rods are positioned to a first side of the curved portion of the baffle and a second portion of the heating rods are positioned to a second side of the curved portion of the baffle.

* * * * *